US006209683B1

(12) United States Patent
Holtz

(10) Patent No.: US 6,209,683 B1
(45) Date of Patent: Apr. 3, 2001

(54) ADJUSTABLE SAWHORSE

(76) Inventor: Dale Roy Holtz, 34488 Eton Crescent, Abbotsford, British Columbia (CA), V2S 4W3

( * ) Notice: Subject to any disclaimer, the term of this patent is extended or adjusted under 35 U.S.C. 154(b) by 0 days.

(21) Appl. No.: 09/358,470

(22) Filed: Jul. 22, 1999

(51) Int. Cl.[7] ..... E04B 1/32; E04B 1/34

(52) U.S. Cl. ..... 182/225; 182/186.1; 182/153; 182/155

(58) Field of Search ..... 182/153, 155, 182/181.1, 182.4, 182.5, 186.1, 224, 225, 228.1–228; 248/188.5; D25/67

(56) References Cited

U.S. PATENT DOCUMENTS

| | | | | |
|---|---|---|---|---|
| D. 280,440 | | 9/1985 | Gromer, Jr. | D25/67 |
| 1,169,700 | * | 1/1916 | Waltower | 182/166 |
| 1,648,844 | * | 11/1927 | Frisk | 182/228.1 X |
| 2,506,896 | * | 5/1950 | Shakowitz | 182/155 |
| 2,755,981 | * | 7/1956 | Edwards | 182/228.6 X |
| 3,110,360 | | 11/1963 | Hearn . | |
| 3,268,031 | * | 8/1966 | Hampson | 182/228.1 X |
| 3,858,684 | * | 1/1975 | Goings | 182/228.6 X |
| 4,024,929 | * | 5/1977 | Mintz | 182/228.1 X |
| 4,289,215 | * | 9/1981 | Robinson | 182/228.1 X |
| 4,298,093 | * | 11/1981 | Wing | 182/153 |
| 4,565,263 | | 1/1986 | Southworth | 182/184 |
| 4,804,064 | | 2/1989 | Coultrup et al. | 182/155 |
| 5,954,156 | * | 9/1999 | Cooke | 182/153 |

* cited by examiner

*Primary Examiner*—Daniel P. Stodola
*Assistant Examiner*—Hugh B. Thompson
(74) *Attorney, Agent, or Firm*—Norman M. Cameron

(57) ABSTRACT

A sawhorse includes an upper cross member having two ends. A pair of legs is hingedly connected to each end of the upper cross member. Each leg has an upper portion and a lower portion slidingly received by the upper portion. Each leg is therefore independently adjustable in length. There is a latch mechanism on each leg for releasibly latching the upper and lower portion of each leg together. A plurality of spaced-apart steps extend between the legs on each side of the sawhorse. The steps are parallel to the upper cross member. At least one of the steps is removable. Preferably at least one of the steps is removably connected to the lower portions of the legs.

8 Claims, 6 Drawing Sheets

ADJUSTABLE SAWHORSE

BACKGROUND OF THE INVENTION

This invention relates to sawhorses and, in particular, to adjustable sawhorses.

The prior art reveals the concept of sawhorses or trestles having adjustable legs. These are useful when the device is used on uneven surfaces such as steps. Independently adjustable legs allow the upper cross member to be oriented horizontally at a desired height when the device is used on sloped or uneven surfaces. For example, U.S. Pat. No. 2325592to Degler discloses a trestle with telescopically adjustable legs.

U.S. Pat. No. 4565263 to Southworth discloses a sawhorse having adjustable leg assemblies that are selectively extendable and retractable to allow the cross beam to be moved to a selected elevation.

U.S. Pat. No. 4804064 to Coultrup et al. discloses a lightweight sawhorse where the respective lengths of each of the legs may be adjusted independently of one another.

A collapsible and adjustable trestle is disclosed in U.S. Pat. No. 3139950 to Borman.

U.S. Pat. Des. 280440 to Gromer Jr. shows an adjustable trestle with cross members extending between the legs.

U.S. Pat. No. 3110360 to Hearn discloses a sawhorse which is collapsible for storage.

It is therefore known in the prior art to provide sawhorses or trestles which are adjustable in height and have individually adjusted legs and cross members between the legs. However, there are limits to the maximum effective height of such sawhorses because, if the legs are extended beyond a certain height, the top of the sawhorse becomes inaccessible to the user. This is particularly true for sawhorses with telescopic legs. If the lower telescopic portions of the legs are too long, the top of the sawhorse may become effectively inaccessible.

It is therefore an object of the invention to provide an improved sawhorse having a top which is more accessible to the user.

Is also an object of the invention to provide an improved sawhorse having legs which are adjustable in height, but having a top which remains accessible to the user even when the legs are extended a significant distance.

It is a further object of the invention to provide an improved sawhorse which is simple and rugged in construction and which can be collapsed and stored conveniently when not in use.

SUMMARY OF THE INVENTION

There is provided, according to the invention, a sawhorse which has an upper cross member having two ends. There is a pair of legs hingedly connected to each end of the upper cross member. Each leg has an upper portion and a lower portion slidingly received by the upper portion. Each leg is independently adjustable in length. There is a latch mechanism on each leg for releasibly latching the upper and lower portion of each said leg together. There is a plurality of space-apart steps extending between the legs on each side of the sawhorse. The steps are parallel to the upper cross member. At least one of the steps is removal.

The latch mechanism may include a plurality of spaced-apart slots in the lower portion of each leg and a latch slidingly and selectively engagable in one of the slots.

Preferably the sawhorse includes one step fixedly connected to the upper portions of the legs on each side of the sawhorse. Each of the steps has opposite ends. One latch is mounted on each end of the one step.

In a preferred embodiment, at least some of the steps are removably connected to the lower portions of the legs.

DETAILED DESCRIPTION OF THE PREFERRED EMBODIMENTS

Figure 1:
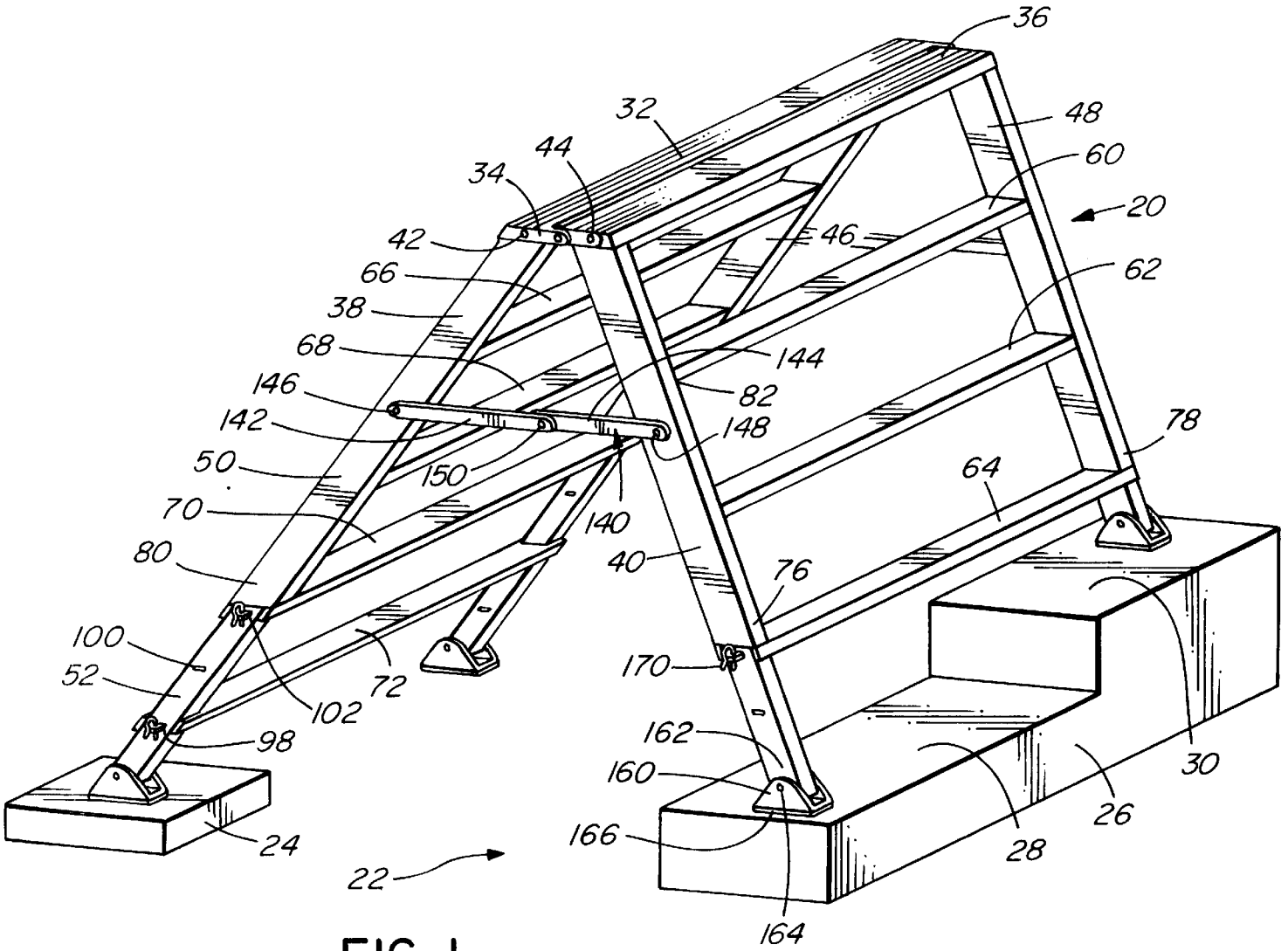
FIG. 1 is an isometric view of a sawhorse according to an embodiment of the invention shown resting on an uneven surface.

Referring first FIG. 1, this shows a sawhorse 20 according to an embodiment of the invention resting on an uneven surface 22 which includes a block 24 and a structure 26 having two steps 28 and 30.

The sawhorse includes an upper cross member 32 having opposite ends 34 and 36. A pair of legs 38 and 40 is hingedly connected to the cross member by rivets 42 and 44 in this example. Another pair of legs 46 and 48 are hingedly connected to opposite end 36.

Each leg has an upper portion 50 which, in this embodiment, is a rectangular tube. This and the other major components in this embodiment are of aluminum although other materials could be substituted. Each leg also has a lower portion 52 which in this embodiment is also a tubular member, smaller in section than the upper portion and telescopically received therein. The lower portion is, accordingly, slidingly received by the upper portion so each leg is independently adjustable in length.

There is a plurality of spaced-apart steps extending between the legs on each side of the sawhorse. In this example there are three such steps 60, 62 and 64 on one side and four steps 66, 68, 70 and 72 on the other side. In this example the upper two steps 60, 62, 66 and 68 on the two sides of the sawhorse are fixedly connected to the upper portions 50 of the legs, by welding in this particular case.

The upper two steps on each side are formed by an inverted channel with ribs on the top for grip and strength.

Figure 3:
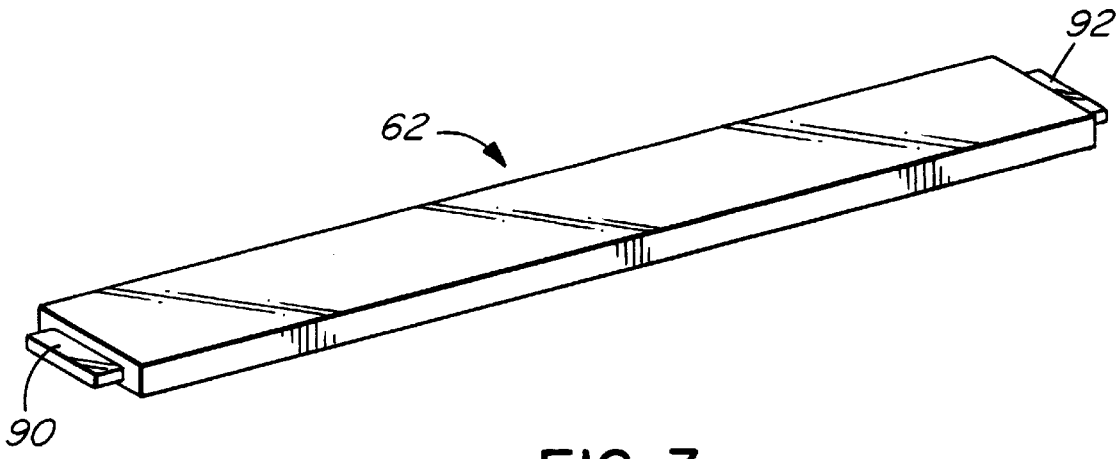
FIG. 3 is an isometric view of one of the steps connecting the upper portions of the legs on one side thereof.
Figure 4:
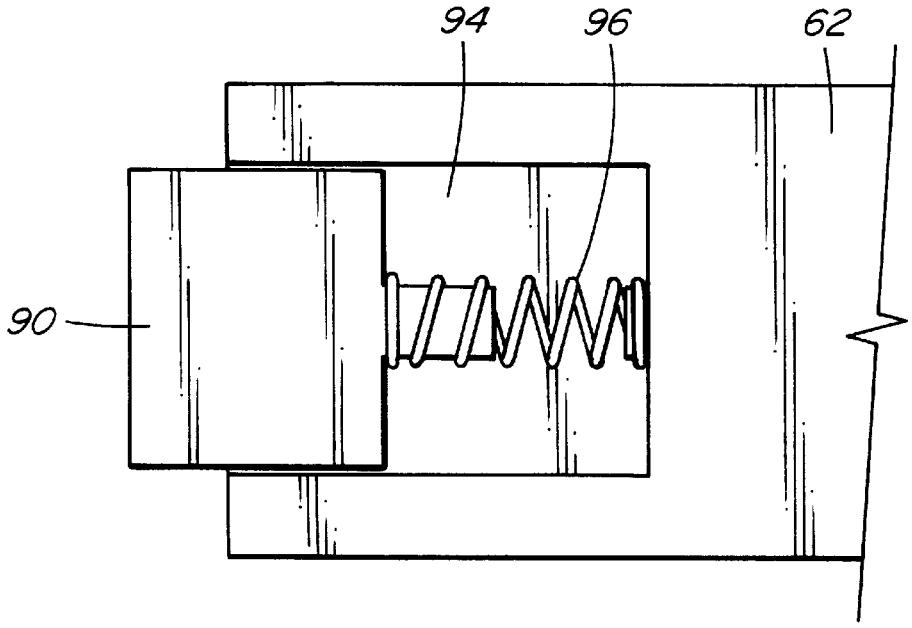
FIG. 4 is a fragmentary bottom plan view of one end thereof.

FIG. 3 illustrates step 62. Step 68 is identical. Each of these steps has a projection 90 and 92 at each end. As shown in FIG. 4, for projection 90, each projection is a latch-like member slidingly received in a recess 94 at one end of the step. The projection is biased outwardly by a spring 96.

The lower portions 52 of the legs are provided with a plurality of spaced-apart slots, such as slots 98,100 and 102 shown on leg 38. The projections 90 extend through slots in the upper portions of the legs and releasibly fit into a selected slot 98, 100 or 102, to latch the upper and lower portion of each leg together in a desired position. A cover plate, not shown, is screwed onto each of the legs 62 and 68 over the projections and springs to hold them in the recesses.

Steps 64, 70 and 72 are removably connected to the lower portions 52 of legs 38 and 46. Additional removable steps may be used, depending upon the degree of extension of the legs. In this example one removable step 64 is used between legs 40 and 48 because they are not extended as far as legs 38 and 46. However a plurality of additional steps could alternatively be placed on each side if the legs are extended higher than legs 38 and 46. Alternatively no removable steps could be used on a side if the legs are not extended far enough.

Figure 5:
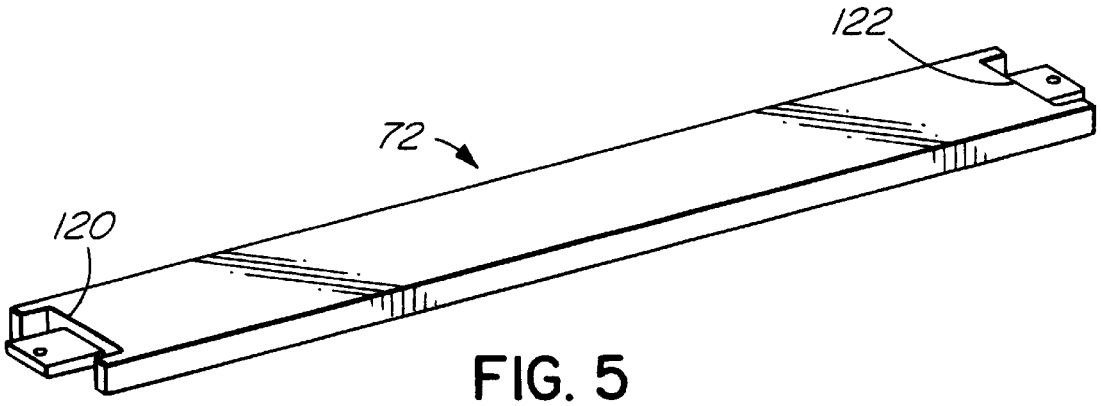
FIG. 5 is a top isometric view of one of the removable steps thereof.
Figure 6:
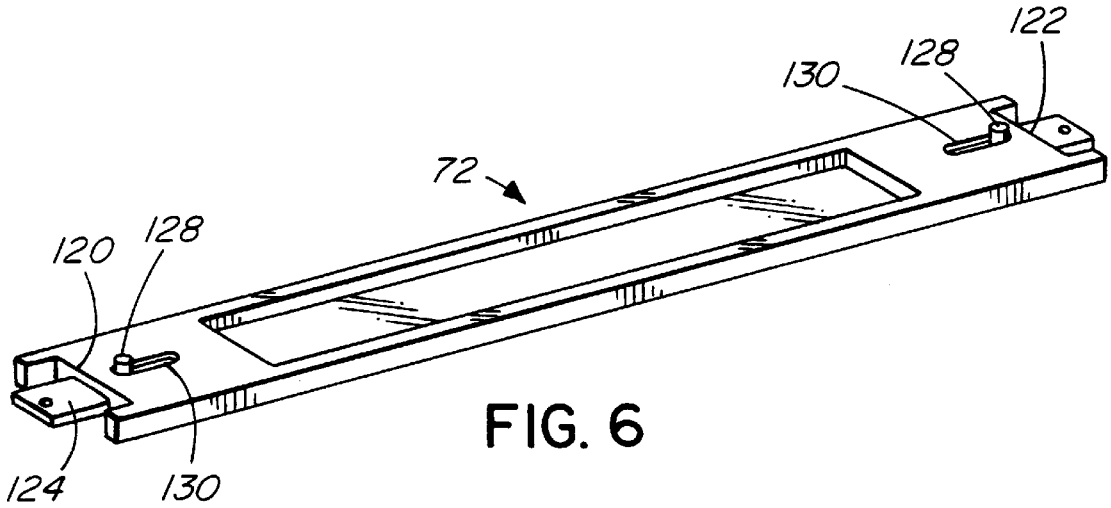
FIG. 6 is a bottom, isometric view thereof.
Figure 7:
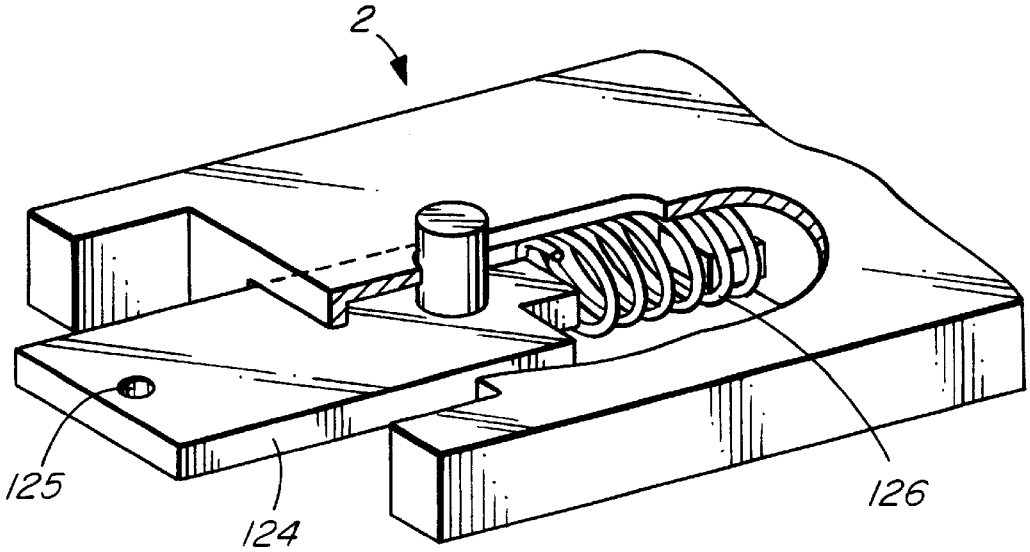
FIG. 7 is a fragmentary isometric view of one end thereof showing one of the projections releasibly engagable with the legs.

Removable step 72 is illustrated in FIGS. 5–7. It has a rectangular recess 120 at one end and a similar recess 122 at the opposite end. The lower portions 52 of the legs 38 and 46 are received in the recesses. There is a projection 124 in each of the recesses. The projections are movable and are biased outwardly by a coil spring 126 as seen in FIG. 7. There is a rod 128 connected to the projection 124 and extending slidingly through a slot 130 at each end of the step. The rod allows the user to attract the projection to position the removable step. Once positioned adjacent one of the slots 98,100 or 102, the rod can be released so the projection extends through the slot to hold the removable step in place.

Each of the projections 124 in this example is provided with a small aperture 125 shown in FIG. 7. A split pin 170, shown in FIG. 1, is inserted through the aperture when the step is in place to prevent it from being accidentally dislodged.

Figure 10:
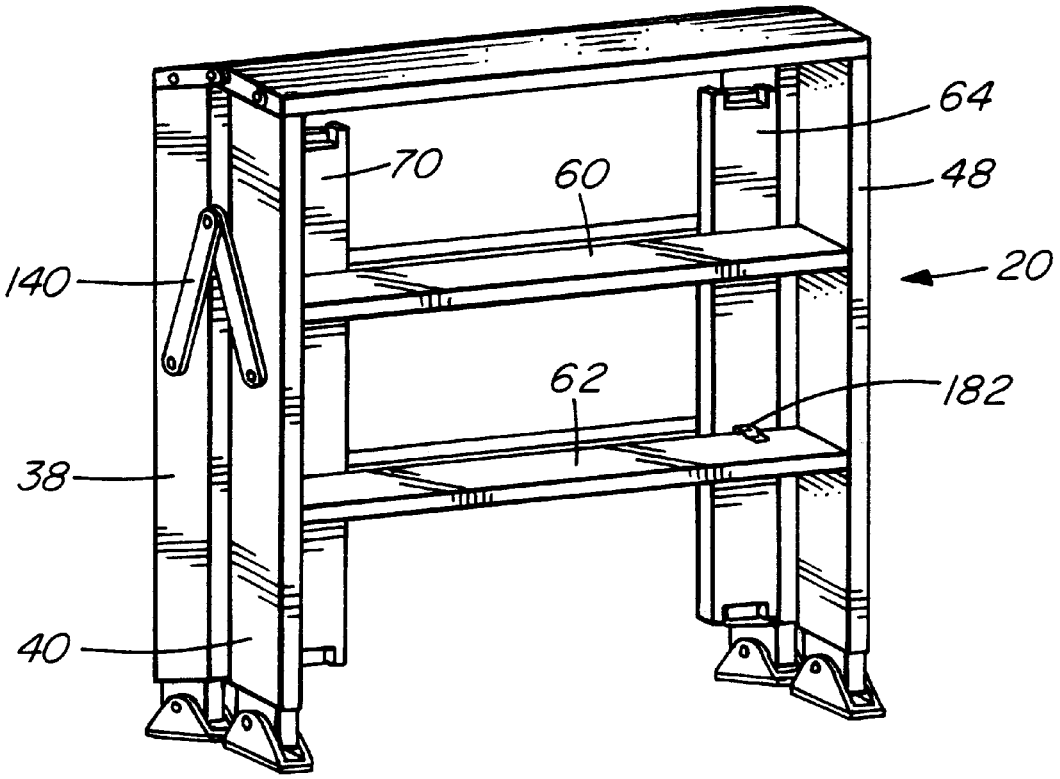
FIG. 10 shows the sawhorse of FIG. 1 collapsed in the storage position.
Figure 11:
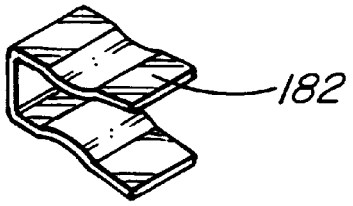
FIG. 11 is an isometric view of one of the clips used for connecting a removable step connected to a fixed step for storage.
Figure 12:
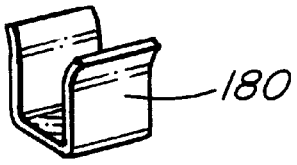
FIG. 12 is another clip used for so connecting the removable step.

Referring to FIGS. 10–12, each of the removable steps is provided with a pair of clips 180 and 182. FIG. 10 shows sawhorse 20 in the storage position with the legs collapsed adjacent each other. Removable steps 64 and 70 are shown in the storage position connected to steps 60 and 62. Clip 182 is shown fitted over step 62. Clip 180 clips under step 60. It may be seen that the removable steps are stored perpendicular to the fixed steps 60 and 62.

Referring to FIG. 1, there is a brace 140, comprising two links 142 and 144, pivotally connected to the legs 38 and 40 by rivets 146 and 148 and to each other by rivets 150. This brace serves to limit outward pivoting of the legs. A similar brace can also be used at the opposite end of the sawhorse. The brace is bent when the sawhorse is in the storage position as shown in FIG. 10.

In this example each of the legs is provided with a foot, such as foot 160 at bottom 162 of leg 40. Each foot is pivotally connected to the leg by a rivet 164 in this example. A rubber pad 166 is fixed to the bottom of each foot.

Figure 2:
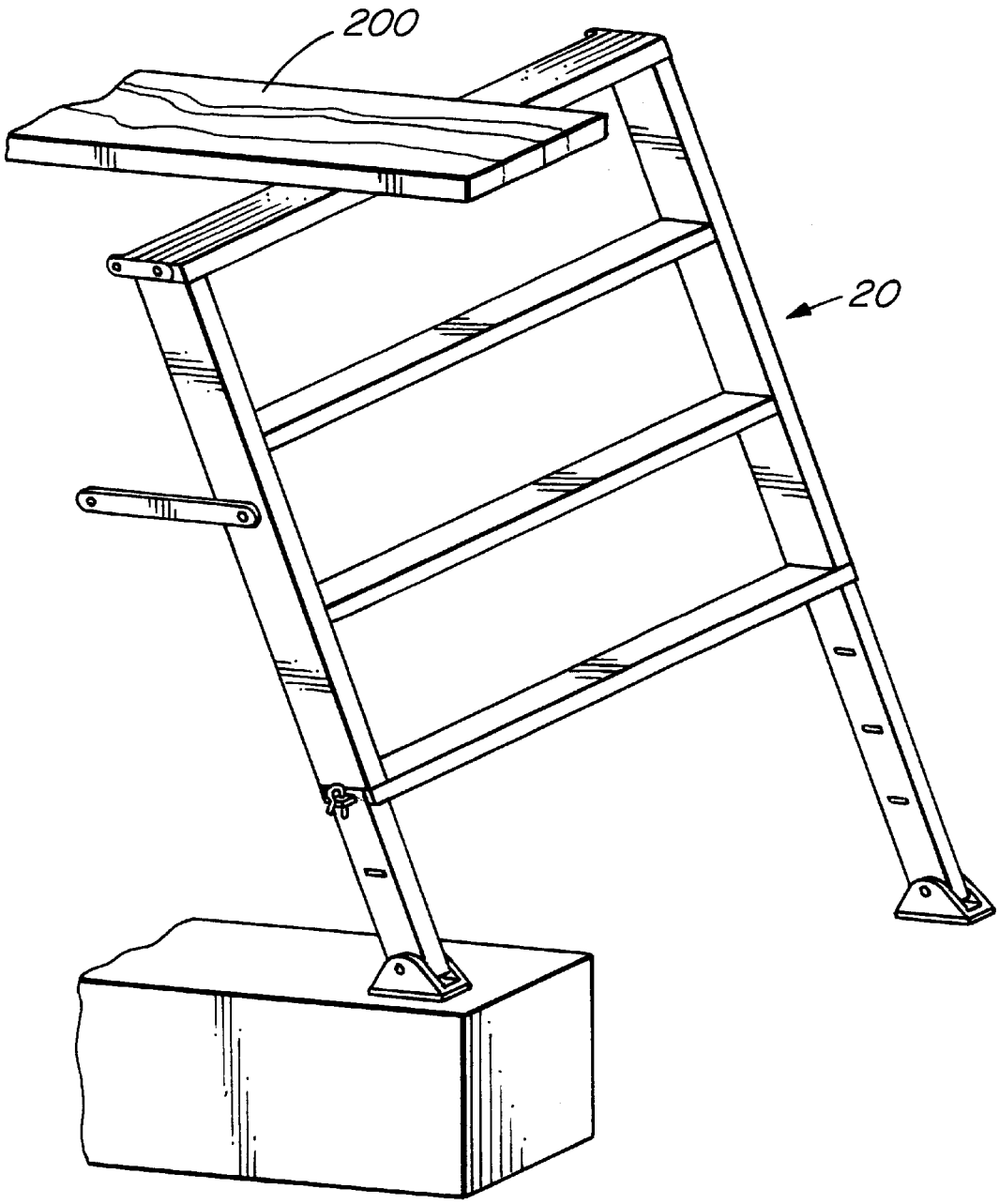
FIG. 2 is a fragmentary, isometric view thereof, showing a plank resting on the top thereof.
Figure 8:
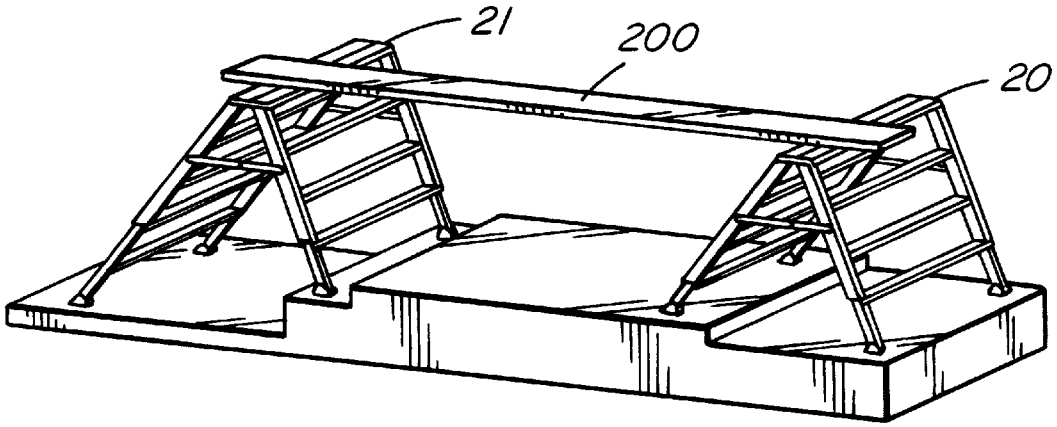
FIG. 8 is an isometric view showing two sawhorses according to an embodiment of the invention supporting a plank on an uneven surface.
Figure 9:
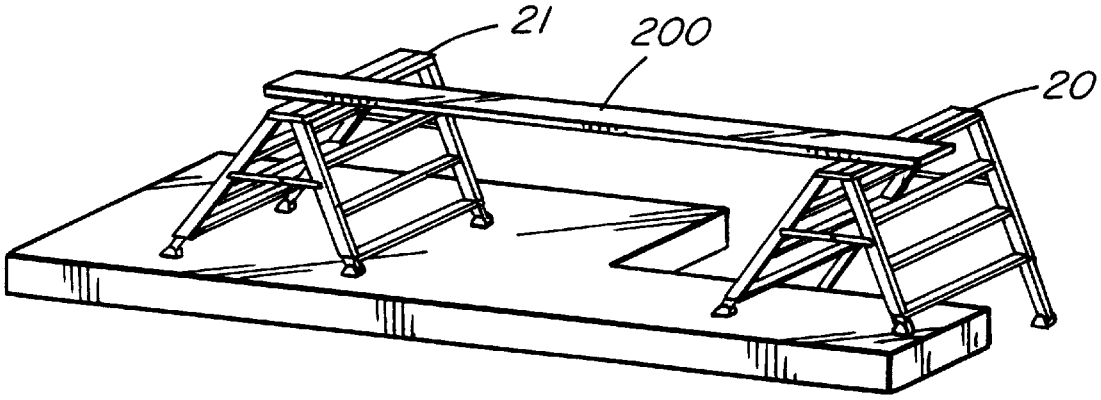
FIG. 9 is a view similar to FIG. 8 on an alternative uneven surface.

FIGS. 2, 8 and 9 show the sawhorse 20, together with another similar sawhorse 21 in FIGS. 8 and 9, used in different positions on different surfaces and supporting a plank 200 between the sawhorses. These show the flexibility of the sawhorses for use in different situations on steps or uneven surfaces.

It will be understood by someone skilled in the art, that many of the details provided above are by way of example only and are not intended to limit the scope of the invention which is to be interpreted with reference to the following claims.

What is claimed is:

1. A sawhorse, comprising:

an upper cross member having two ends;

a pair of legs hingedly connected to each end of the upper cross member, each said leg having an upper portion and a lower portion slidingly received by the upper portion, whereby each said leg is independently adjustable in length;

a latch mechanism on each said leg for releasibly latching said upper and lower portion of said each leg together; and a plurality of spaced-apart steps extending between the legs on each side of the sawhorse, the steps being parallel to the upper cross member, at least one of the steps being removably connected to the lower portions of the legs, at least some of the steps being fixedly secured to the upper portions of the legs, said at least one removably connected step having clips securing said at least one of the removably connected steps to said at least some fixedly connected steps in a storage condition.

2. A sawhorse as claimed in claim 1, wherein the latch mechanism includes a plurality of spaced-apart first slots in said lower portion of each said leg and a latch slidingly and selectively engagable in one of the first slots.

3. A sawhorse as claimed in claim 2, wherein each said removably connected step having opposite ends, one said latch being mounted on each said end of each said removably connected step.

4. A sawhorse as claimed in claim 3, wherein the lower portions of the legs have a plurality of spaced-apart slots, the removably connected step having projections selectively extendable through the slots.

5. A sawhorse as claimed in claim 4, wherein each of the projections has an aperture, the sawhorse including a pin releasibly extending through each said aperture to lock said at least one removably connected step in position.

6. A sawhorse as claimed in claim 1, including a brace with two pivotally connected links pivotally connected to each said pair of legs below the upper cross member.

7. A sawhorse as claimed in claim 1, wherein the lower portion of each said leg has a bottom and a foot member pivotally connected to said bottom.

8. A sawhorse as claimed in claim 1, wherein said at least one of the removably connected steps is secured perpendicularly to the fixedly secured steps for storage.

* * * * *